US010156391B2

(12) United States Patent
Zhou et al.

(10) Patent No.: US 10,156,391 B2
(45) Date of Patent: Dec. 18, 2018

(54) REFRIGERANT DISTRIBUTING COMPONENT, HEADER ASSEMBLY, AND HEAT EXCHANGER

(71) Applicant: SANHUA (HANGZHOU) MICRO CHANNEL HEAT EXCHANGER CO., LTD., Hangzhou (CN)

(72) Inventors: Jing Zhou, Hangzhou (CN); Yan He, Hangzhou (CN); Huazhao Liu, Hangzhou (CN); Qiang Gao, Hangzhou (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 380 days.

(21) Appl. No.: 14/914,191

(22) PCT Filed: Jan. 16, 2014

(86) PCT No.: PCT/CN2014/070743
§ 371 (c)(1),
(2) Date: Feb. 24, 2016

(87) PCT Pub. No.: WO2015/027681
PCT Pub. Date: Mar. 5, 2015

(65) Prior Publication Data

US 2016/0209091 A1 Jul. 21, 2016

(30) Foreign Application Priority Data

Aug. 27, 2013 (CN) ..... 2013 1 0378731

(51) Int. Cl.
*F25B 39/00* (2006.01)
*F28F 9/02* (2006.01)
(Continued)

(52) U.S. Cl.
CPC ..... *F25B 39/00* (2013.01); *F28F 9/0202* (2013.01); *F28F 9/028* (2013.01); *F28F 9/0265* (2013.01);
(Continued)

(58) Field of Classification Search
CPC ..... F28F 9/22; F28F 9/0202; F28F 9/0273; F28F 9/0275; F28F 9/0278; F25B 39/00; F25B 39/028
See application file for complete search history.

(56) References Cited

U.S. PATENT DOCUMENTS

2016/0209091 A1 7/2016 Zhou et al.

FOREIGN PATENT DOCUMENTS

| | | | |
|---|---|---|---|
| CN | 101592448 | A | 12/2009 |
| CN | 101943539 | A | 1/2011 |
| CN | 103411463 | A | 11/2013 |

OTHER PUBLICATIONS

Translation of CN 101943539A.*
(Continued)

*Primary Examiner* — Elizabeth J Martin
(74) *Attorney, Agent, or Firm* — Howard & Howard Attorneys PLLC

(57) ABSTRACT

A refrigerant distributing component includes a body. The body has a distributing cavity extending along a length direction of the body therein and an inner sidewall of the distributing cavity has a plurality of distributing hole therein, wherein refrigerants sprayed from one part of the distributing holes collide with refrigerants sprayed from another part of the distributing holes.

16 Claims, 9 Drawing Sheets

(51) Int. Cl.

| | |
|---|---|
| *F28D 1/053* | (2006.01) |
| *F28F 1/12* | (2006.01) |
| *F25B 39/02* | (2006.01) |

(52) U.S. Cl.

CPC ..... *F28F 9/0273* (2013.01); *F28F 9/0275* (2013.01); *F28F 9/0278* (2013.01); *F25B 39/028* (2013.01); *F28D 1/05366* (2013.01); *F28F 1/126* (2013.01); *F28F 2255/16* (2013.01)

(56) References Cited

OTHER PUBLICATIONS

International Search Report and Written Opinion of the International Searching Authority for PCT International Application No. PCT/CN2014/070743 dated May 28, 2014.

* cited by examiner

REFRIGERANT DISTRIBUTING COMPONENT, HEADER ASSEMBLY, AND HEAT EXCHANGER

CROSS-REFERENCE TO RELATED APPLICATION

This application is a U.S. National Phase application of the International Patent Application No. PCT/CN2014/070743, filed Jan. 16, 2014, which claims the benefit of prior Chinese Application No. 201310378731.5 filed Aug. 27, 2013. The entire contents of the above-mentioned patent applications are incorporated by reference as part of the disclosure of this U.S. application.

BACKGROUND OF THE INVENTION

1. Field of the Invention

The present disclosure relates to a field of refrigeration technology, and more particularly to a refrigerant distributing component, a header assembly and a heat exchanger.

2. Description of the Related Art

In order to improve performances of a heat exchanger, a refrigerant distributing component is normally disposed in the header of the heat exchanger, e.g., a circular tube having distributing holes in a wall thereof. When the heat exchanger is used as an evaporator or an outdoor heat pump, the refrigerants entering an inlet of the heat exchanger are in a two-phase state of mixed vapour and liquid. A vapour-liquid separation occurs to the refrigerants in a distributing device, and refrigerants sprayed from one part of the distributing holes are all liquids and refrigerants sprayed from another part of the distributing holes are all vapours, resulting in an uneven distribution of the refrigerants entering each flat tube of the heat exchanger. Moreover, after the refrigerants with two phases of vapour and liquid flow through the distributing holes, a vapour-liquid separation phenomenon may also be caused by a difference in density of the refrigerants in vapour and liquid phase, thus the refrigerants cannot be distributed into each flat tubes evenly.

SUMMARY OF THE INVENTION

The present disclosure seeks to solve at least one of the problems existing in the related art to at least some extent.

Therefore, an objective of the present disclosure is to provide a refrigerant distributing component, which can reduce a vapour-liquid separation phenomenon.

Another objective of the present disclosure is to provide a header assembly having the refrigerant distributing component described above.

Another objective of the present disclosure is to provide a header assembly, which can reduce the vapour-liquid separation phenomenon of the refrigerants.

Another objective of the present disclosure is to provide a heat exchanger having the header assembly described above.

The refrigerant distributing component according to embodiments of a first aspect of the present disclosure includes: a body having a distributing cavity extending in a length direction of the body therein, and an inner sidewall of the distributing cavity has a plurality of distributing holes therein, refrigerants sprayed from one part of the distributing holes collide with refrigerants sprayed from another part of the distributing holes.

According to the refrigerant distributing component of embodiments of the present disclosure, since the refrigerants sprayed from one part of the distributing holes collide with refrigerants sprayed from another part of the distributing holes, the two-phase refrigerants mix evenly under a strong disturbance effect caused by the collision of refrigerants, so as to reduce the vapour-liquid separation phenomenon of the refrigerants, facilitate a more even distribution of the refrigerants into heat exchanging tubes and improve an homogeneity of the distribution of the refrigerants in the heat exchanger, thus improving the performance of the heat exchanger.

In some embodiments of the present disclosure, the distributing holes are divided into a plurality of groups, and refrigerants sprayed from at least one group of the distributing holes collide with refrigerants sprayed from at least another group of the distributing holes.

Preferably, refrigerants sprayed from any two groups of the distributing holes collide with each other.

Alternatively, the distributing holes in each group are arranged in a line in the length direction of the body.

According to some embodiments of the present disclosure, the distributing holes are divided into a plurality of groups, and refrigerants sprayed from one part of the distributing holes in any group collide with refrigerants sprayed from another part of the distributing holes in the same group.

In some embodiments of the present disclosure, the body has an arc-shaped cross-section, and the refrigerants sprayed from one part of the distributing holes collide with the refrigerants sprayed from another part of the distributing holes in a circle in which a center of the body serves as a center of the circle and a radius of the body serves as a radius of the circle.

According to some embodiments of the present disclosure, the distributing cavity includes a plurality of distributing channels which are arranged and spaced apart in a circumferential direction of the body.

Specifically, an inner sidewall of each distributing channel has at least one row of the distributing holes therein.

In some embodiments of the present disclosure, the body has an arc-shaped cross-section and the distributing channel has a circular cross-section, a distance from the center of the distributing channel to the center of the body is L and a hydraulic diameter of the distributing channel is R, and an included angle between two lines connecting centers of the distributing holes of two outermost distributing channels to the center of the circle is $\alpha$, wherein $2N \arctan(R/L)<\alpha<\pi$.

In some other embodiments of the present disclosure, the body has an arc-shaped cross-section and the distributing channel has an arc-shaped cross-section.

Further, a circumferential groove is provided in inner surfaces of two ends of the body.

The header assembly according to a second aspect of embodiments of the present disclosure includes: a header; a refrigerant distributing component according to the first aspect of embodiments of the present disclosure, disposed in the header.

The header assembly according to embodiments of the present disclosure, through the refrigerant distributing component, can reduce the vapour-liquid separation phenomenon of the refrigerants and improve the homogeneity of the distribution of the refrigerants, thus improving the performance of the heat exchanger.

Specifically, an outer wall surface of the body of the refrigerant distributing component is conformed together with an inner wall of the header.

The header assembly according to a third aspect of embodiments of the present disclosure includes: a header; a refrigerant distributing component including a body which is disposed in the header and divides an inner cavity of the header into an distributing cavity and a mixing cavity and has a plurality of distributing holes communicating the distributing cavity and the mixing cavity, wherein refrigerants sprayed from one part of the distributing holes collide with refrigerants sprayed from another part of the distributing holes in the mixing cavity.

According to the header assembly of embodiments of the present disclosure, since the refrigerants sprayed from one part of the distributing holes collide with refrigerants sprayed from another part of the distributing holes in the mixing cavity, the two-phase refrigerants mix evenly under a strong disturbance effect caused by the collision of refrigerants, so as to reduce the vapour-liquid separation phenomenon of the refrigerants, facilitate a more even distribution of the refrigerants into heat exchanging tubes and improve an homogeneity of the distribution of the refrigerants in the heat exchanger, thus improving the performance of the heat exchanger.

Alternatively, the body is formed as a plate having an arc-shaped or a corrugated cross-section.

Further, two longitudinal edges of the body respectively each have a turn-down conformed with an inner wall of the header.

In some embodiments of the present disclosure, a surface of the body adjacent to the distributing cavity has a separating rib extending in a length direction of the body, and the separating rib divides the distributing cavity into a plurality of distributing channels.

Preferably, the distributing holes are divided into a plurality of groups, and refrigerants sprayed from any two groups of the distributing holes collide with each other.

The heat exchanger according to a fourth aspect of embodiments of the present disclosure includes a header assembly according to the second or the third aspect of embodiments of the present disclosure.

BRIEF DESCRIPTION OF THE DRAWINGS

Other advantages of the invention will be readily appreciated as the same becomes better understood by reference to the following detailed description when considered in connection with the accompanying drawings, wherein.

REFERENCE NUMERALS

Figure 1:
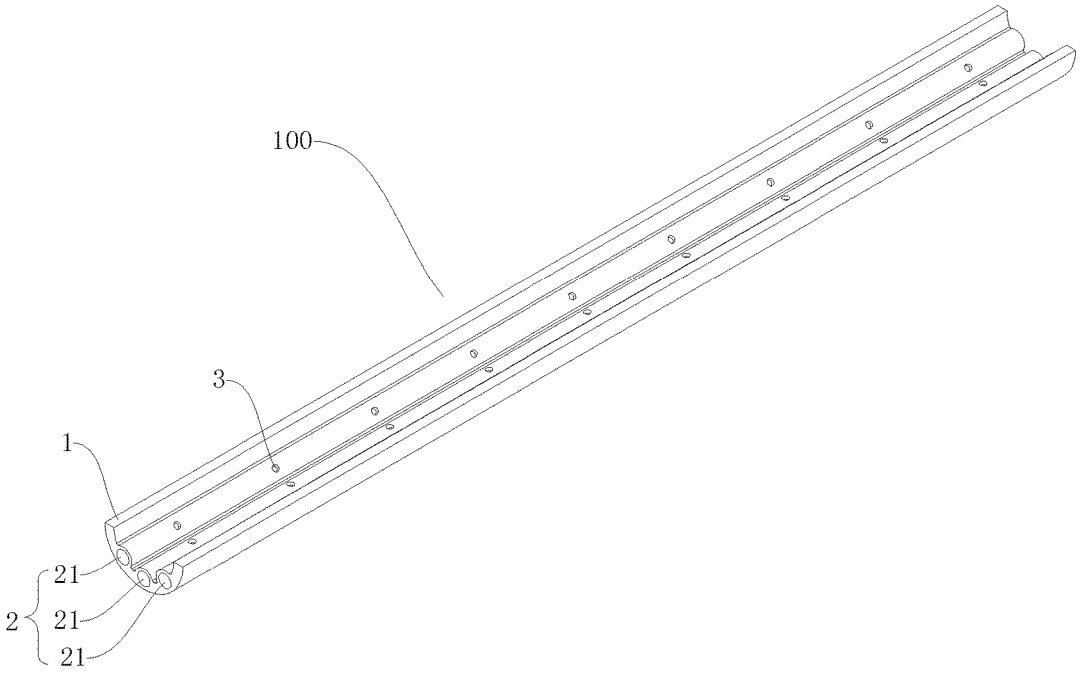
FIG. 1 is a perspective view of a refrigerant distributing component according to a first embodiment of the present disclosure.

Refrigerant distributing component 100; body 1; turn-down 11; distributing cavity 2;
distributing channel 21; distributing channel opening segment 22; separating rib 23; distributing hole 3;
circumferential groove 4; partition plate 5; partition plate hole 51; mixing cavity 6; header 200;
liquid reserving and guiding segment 201; refrigerant distributing segment 202; heat exchanging tube 300; fin 400.

DETAILED DESCRIPTION OF THE INVENTION

Embodiments of the present disclosure will be described in detail and examples of the embodiments will be illustrated in the drawings, where same or similar reference numerals are used to indicate same or similar members or members with same or similar functions. The embodiments described herein with reference to drawings are explanatory, which are used to illustrate the present disclosure, but shall not be construed to limit the present disclosure.

A refrigerant distributing component 100 according to embodiments of the present disclosure is described with reference to FIG. 1 to FIG. 11. The refrigerant distributing component 100 is disposed in a header of a heat exchanger and used to distribute the refrigerant to the header, so that the refrigerant can be distributed evenly among heat exchanging tubes of the heat exchanger.

As shown in FIG. 1 to FIG. 11, the refrigerant distributing component 100 according to embodiments of the present disclosure includes a body 1 having an distributing cavity 2 extending in a length direction (a left-right direction in FIG. 5) of the body 1, an inner sidewall (upper wall in FIG. 1) of the distributing cavity 2 has a plurality of distributing holes 3 therein. It should be understood that a shape of a cross-section of the distributing cavity 2 may be any appropriate shape, such as a circle, an arc or a rectangle. Moreover, a size, a shape, a position and an opening direction of each distributing hole may be designed according to a practical appliance. Preferably, the plurality of the distributing holes 3 may be distributed evenly. Preferably, the distributing hole 3 is configured to be a slot, thus further improving the uniformity of the distribution of the refrigerant.

According to the refrigerant distributing component 100 of embodiments of the present disclosure, in the plurality of the distributing holes 3, refrigerants sprayed from one part of the distributing holes 3 collide with refrigerants sprayed from another part of the distributing holes 3, in other words, the refrigerants sprayed from one part of the distributing holes 3 and the refrigerants sprayed from another part of the distributing holes 3 spray to each other. Therefore, the counter-spraying of the refrigerants can be realized according to the refrigerant distributing component 100 of embodiments of the present disclosure.

Specifically, the refrigerants enter the distributing cavity 2 and spray out from the plurality of the distributing holes 3, and the refrigerants sprayed from one part of the distributing holes 3 collide with the refrigerants sprayed from another part of the distributing holes 3, in other words, a motion path of the refrigerants sprayed from one part of the distributing holes 3 is intersected with a motion path of the refrigerants sprayed from another part of the distributing holes 3, so that although a vapour-liquid separation phenomenon occurs after the refrigerants with two phases of vapour and liquid leave the distributing holes 3, the two-phase refrigerants will reform a sufficiently mixed vapour-liquid fluid under a strong disturbance effect caused by the collision of refrigerants, thus reducing the vapour-liquid separation phenomenon of the two-phase refrigerants entering the heat exchanging tubes of the heat exchanger.

According to the refrigerant distributing component 100 of embodiments of the present disclosure, since the refrigerants sprayed from one part of the distributing holes 3 collide with refrigerants sprayed from another part of the distributing holes, the two-phase refrigerants mix evenly under a strong disturbance effect caused by the collision of refrigerants, so as to reduce the vapour-liquid separation phenomenon of the refrigerants, facilitate a more even distribution of the refrigerants into heat exchanging tubes and improve the uniformity of the distribution of the refrigerants in the heat exchanger, thus improving the performance of the heat exchanger.

In some embodiments of the present disclosure, the distributing holes 3 are divided into a plurality of groups, for example, the distributing holes 3 in each group are arranged in line in a length direction of the body 1 and may also be arranged in other shapes. The refrigerants sprayed from at least one group of the distributing holes 3 collide with the refrigerants sprayed from at least another group of the distributing holes 3, in other words, the refrigerants sprayed from at least two groups of the plurality of groups of the distributing holes 3 collide with each other. Specifically, it may be that the refrigerants sprayed from one group of the distributing holes 3 collide with the refrigerants sprayed from another group of the distributing holes 3, it may also be that the refrigerants sprayed from one group of the distributing holes 3 collide with the refrigerants sprayed from other groups of the distributing holes 3, and it may further be that the refrigerants sprayed from several groups of the distributing holes 3 collide with the refrigerants sprayed from another several groups of the distributing holes 3. Preferably, the refrigerants sprayed from any two groups of the distributing holes 3 collide with each other, thus further improving the uniformity of a mixing of the two-phase refrigerants.

According to some embodiments of the present disclosure, the distributing holes 3 are divided into a plurality of groups and the refrigerants sprayed from a part of the distributing holes 3 in any group of collide with the refrigerants sprayed from another part of the distributing holes 3 in the same group, in other words, the refrigerants sprayed from each group of the distributing holes 3 may collide with each other.

As shown in FIG. 1 to FIG. 11, in some specific embodiments of the present disclosure, the body 1 has an arc-shaped cross-section, and the refrigerants sprayed from one part of the distributing holes 3 collide with the refrigerants sprayed from another part of the distributing holes 3 in a circle in which a center of the body 1 serves as a center of the circle and a radius of the body 1 serves as a radius of the circle. In other words, the refrigerants sprayed from one part of the distributing holes 3 collide with the refrigerants sprayed from another part of the distributing holes 3 in a circle, and a center of the circle is a center of the body 1 and a radius of the circle is a radius of the body 1. Preferably, as an arrow shown in FIG. 3, a motion path of the refrigerants sprayed from one part of the distributing holes 3 is intersected with a motion path of the refrigerants sprayed from another part of the distributing holes 3 at the center of the circle.

As shown in FIG. 1 to FIG. 11, in some embodiments of the present disclosure, the distributing cavity 2 includes a plurality of distributing channels 21 which are arranged and spaced apart in a circumferential direction of the body 1 and each of the distributing channels 21 has the distributing hole 3 for distributing the refrigerant therein. Preferably, shapes and sizes of the distributing channels 21 are the same.

In some embodiments of the present disclosure, an inner sidewall of each distributing channel 21 has at least one row of the distributing holes 3 therein. For example, in the embodiment shown in FIG. 1 to FIG. 3, the body 1 has three distributing channels 21 which extend in the length direction of the body 1 and are arranged uniformly apart from each other in a circumferential direction of the body 1. The distributing hole 21 has a circular cross-section, an inner sidewall of each distributing channel 21 protrudes inwardly, and the inner sidewall of each distributing channel 21 has a row of the distributing holes 3 arranged in a line therein. It should be understood that a plurality of rows of the distributing holes 3 may be formed in each distributing channel 21, and the distributing holes 3 in each row may be distributed spirally around an axial direction of the distributing channel 21. Preferably, in the embodiment shown in FIG. 1 to FIG. 3, the refrigerants distributed from the distributing holes 3 in the inner wall of the three distributing channels 21 are intersected at the center of the body 1, in other words, the refrigerants sprayed from the three rows of the distributing holes 3 collide with each other at the center of the body 1.

Figure 2:
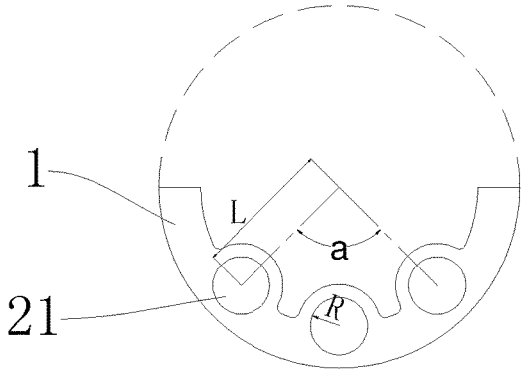
FIG. 2 is a front elevational view of the refrigerant distributing component shown in FIG. 1.

As shown in FIG. 1 to FIG. 9, in some embodiments of the present disclosure, the body 1 has an arc-shaped cross-section, and the distributing channel 21 has a circular cross-section. As shown in FIG. 2, a distance from the center of the distributing channel 21 to the center of the body 1 is L, a hydraulic diameter of the distributing channel 21 is R, and an included angle between two lines connecting centers of distributing holes 3 of two outermost distributing channels 21 to the center of the circle of the body 1 is $\alpha$, wherein $2N \arctan(R/L)<\alpha<\pi$. Inventors of the present application find out that, by meeting the formula of $2N \arctan(R/L)<\alpha<\pi$, the refrigerants after the collision can flow into the heat exchanging tubes more smoothly.

Figure 10:
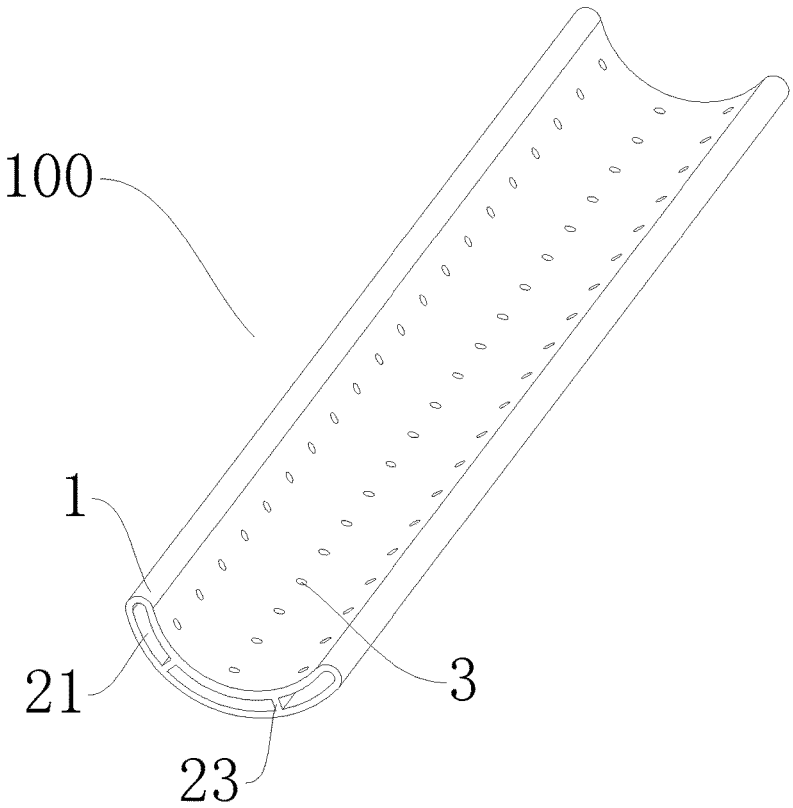
FIG. 10 is a perspective view of a refrigerant distributing component according to a fourth embodiment of the present disclosure.
Figure 11:
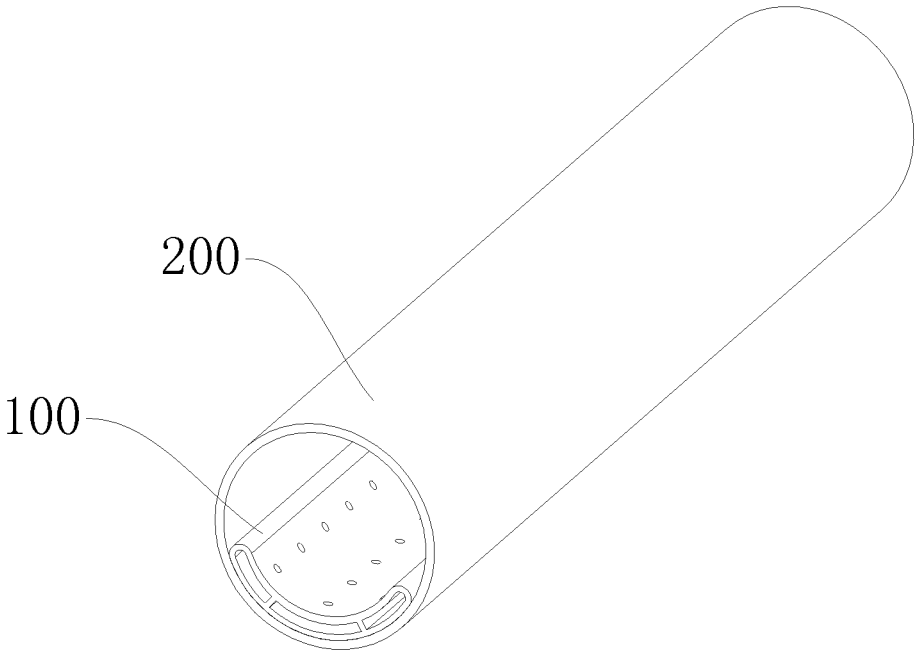
FIG. 11 is a schematic diagram of a header assembly having the refrigerant distributing component shown in FIG. 10.

As shown in FIG. 10 and FIG. 11, in other embodiments of the present disclosure, the body 1 has an arc-shaped cross-section, the distributing channel 21 has an arc-shaped cross-section, and the inner sidewall and the outer sidewall of the body 1 are both arc-shaped. The distributing cavity 2 has two separating ribs 23 therein so as to divide the distributing cavity 2 into three distributing channels 21.

In order to conveniently dispose the body 1 in the header, as shown in FIG. 4 to FIG. 9, circumferential grooves 4 are provided in the inner sidewall surface at two ends of the body 1 and the two partition plates 5 are fitted into the two circumferential grooves 4 respectively. In a flowing direction of the refrigerants, the partition plate 5 located in upper stream of the two partition plates 5 has a partition plate hole 51 fitting with the distributing channel 21, and the partition plate 5 located in lower stream of the two partition plate 5 may have the partition plate hole 51 or may not have the partition plate hole 51. Shapes of parts of the two partition plates 5 outside the circumferential groove 4 fit with the shape of the inner wall of the header, so that the body 1 can be fixed in the header by the partition plate 5 fitting with the inner wall of the header.

Figure 5:
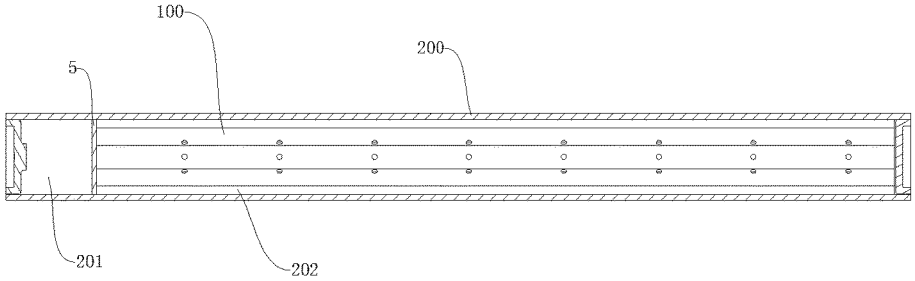
FIG. 5 is a section view of a header assembly having the refrigerant distributing component and a partition plate shown in FIG. 4.
Figure 6:
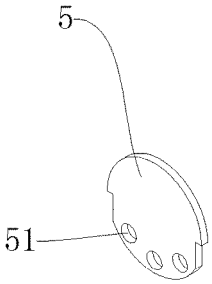
FIG. 6 is a schematic diagram of a partition plate according to an embodiment of the present disclosure.
Figure 7:
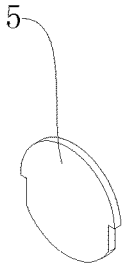
FIG. 7 is a schematic diagram of a partition plate according to an embodiment of the present disclosure.
Figure 8:
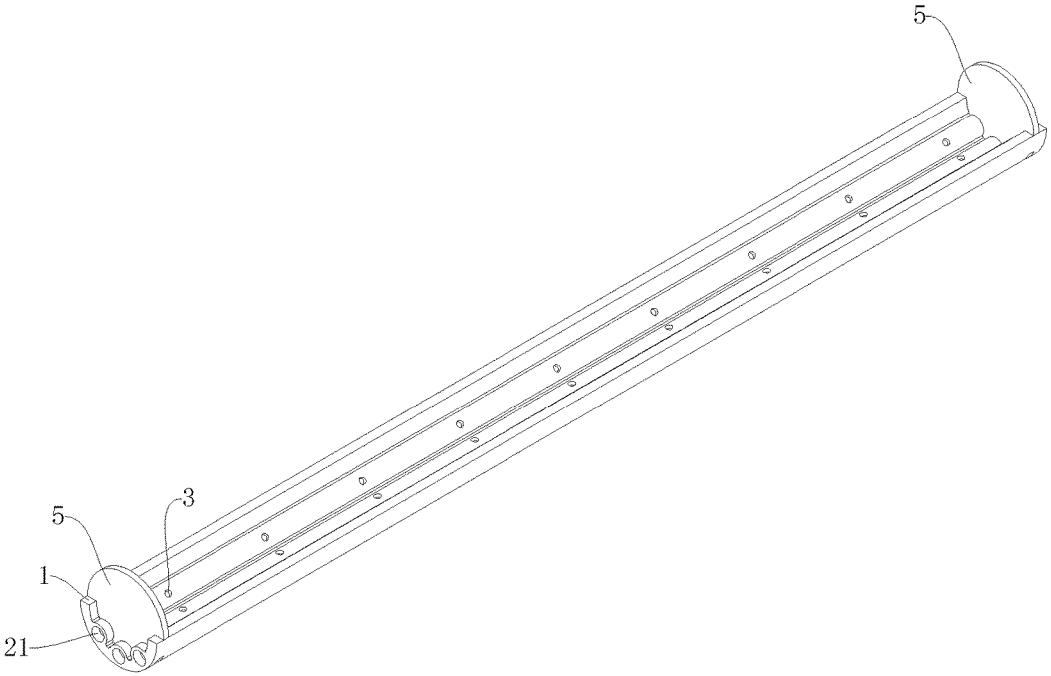
FIG. 8 is a schematic diagram of the refrigerant distributing component shown in FIG. 4 assembled with a partition plate.

As shown in FIG. 5, the partition plate 5 located in upper stream (the left side) divides the inner cavity of the header into a liquid reserving and guiding segment 201 and a refrigerant distributing segment 202, the refrigerant distributing component 100 is disposed in the refrigerant distributing segment 202, and the distributing cavity 2 is communicated with the liquid reserving and guiding segment 201. The refrigerants enter in the liquid reserving and guiding segment 201 first, then enter into the plurality of the distributing channels 21 via the partition plate hole 51 of the partition plate 5 and the refrigerants spray from the distributing holes 3 of each distributing channel 21 to the refrigerant distributing segment 202 and collide in the refrigerant distributing segment 202.

Figure 9:
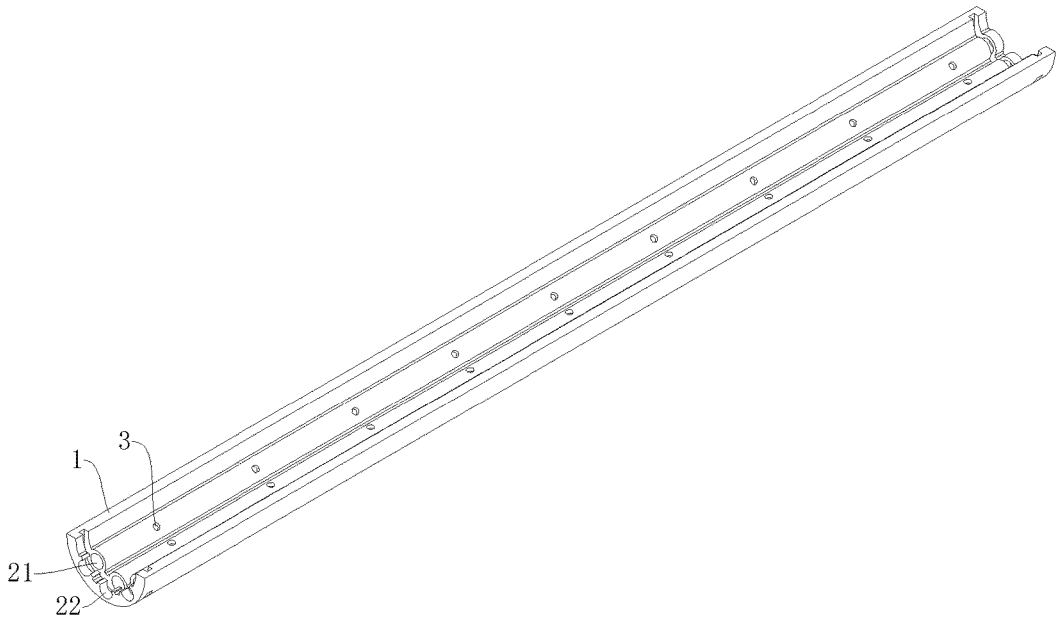
FIG. 9 is a perspective view of a refrigerant distributing component according to a third embodiment of the present disclosure.

In order to make the refrigerants flow into the distributing channel 21 more easily, as shown in FIG. 9, in a further embodiment of the present disclosure, a part of the inner sidewall of the distributing channel 21 between the circumferential groove 4 and an left end-surface of the body 1 is removed so as to form an opening segment 22 of the distributing channel 21. It should be understood that the opening segment 22 of the distributing channel 21 is located in the reserving and guiding segment 201.

Figure 3:
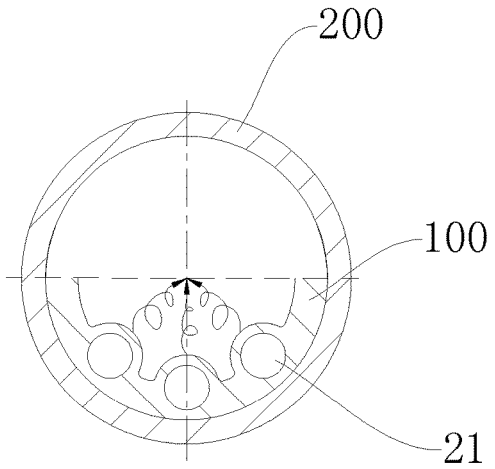
FIG. 3 is a schematic diagram of a header assembly having the refrigerant distributing component shown in FIG. 1.
Figure 4:
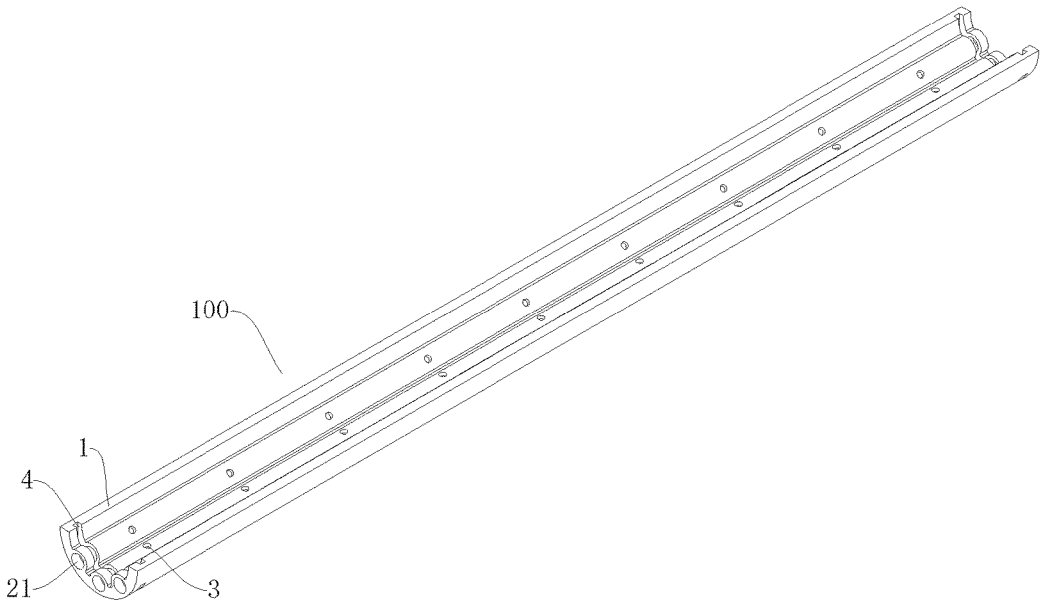
FIG. 4 is a perspective view of a refrigerant distributing component according to a second embodiment of the present disclosure.

A header assembly according to embodiments of the present disclosure is described following with reference to FIG. 3, FIG. 5 and FIG. 11.

As shown in FIG. 3, FIG. 5 and FIG. 11, the header assembly according to embodiments of the present disclosure includes a header 200 and a refrigerant distributing component disposed in the header 200, and the refrigerant distributing component is the refrigerant distributing component 100 according to embodiments described above.

Preferably, an outer sidewall surface of the body 1 of the refrigerant distributing component 100 is conformed together with an inner wall surface of the header 200, and a shape of the outer sidewall surface of the body 1 is fitting with a shape of the inner wall surface of the header 200, so as to facilitate the conformation.

The header assembly according to embodiments of the present disclosure, through the refrigerant distributing component 100, can reduce the vapour-liquid separation phenomenon of the refrigerants and improve the homogeneity of the distribution of the refrigerants, thus improving the performance of the heat exchanger.

A header assembly according to another embodiment of the present disclosure is described following with reference to FIG. 12 to FIG. 17.

As shown in FIG. 12 to FIG. 17, the header assembly according to embodiments of the present disclosure includes a header 200 and a refrigerant distributing component 100.

The refrigerant distributing component 100 includes a body 1, and the body 1 is disposed in the header 200 and divides an inner cavity of the header 200 into an distributing cavity 2 and a mixing cavity 6 and has a plurality of distributing holes 3 communicating the distributing cavity 2 and the mixing cavity 6, refrigerants sprayed from one part of the distributing holes 3 collide with refrigerants sprayed from another part of the distributing holes 3 in the mixing cavity 6.

In a specific embodiment of the present disclosure, the distributing holes 3 are divided into a plurality of groups and the refrigerants sprayed from any two groups of the distributing holes 3 collide with each other.

The body 1 may be fixed in the header 200 by means of a welding, for example.

The refrigerants enter the distributing cavity 2 and spray out from the distributing cavity 2 to the mixing cavity 6, and a motion path of the refrigerants sprayed from one part of the distributing holes 3 and a motion path of the refrigerants sprayed from another part of the distributing holes 3 have intersection points such that collisions occur in the mixing cavity 6, thus although a vapour-liquid separation phenomenon occurs after the refrigerants with two phases of vapour and liquid leave the distributing holes 3, the two-phase refrigerants will reform a sufficiently mixed vapour-liquid fluid under a strong disturbance effect caused by the collision of refrigerants, thus reducing the vapour-liquid separation phenomenon of the two-phase refrigerants entering the heat exchanging tubes 300 of the heat exchanger.

The refrigerants may collide with each other in a radial direction of the header 200, the refrigerants may also collide with each other in an axial direction of the header 200, may further collide with each other in the radial and the axial directions of the header 200 at the same time, and the refrigerants may even collide with each other deviating from a predetermined angle in the radial and the axial directions.

According to the header assembly of embodiment of the present disclosure, since the refrigerants sprayed from one part of the distributing holes 3 collide with refrigerants sprayed from another part of the distributing holes 3 in mixing cavity 6, the two-phase refrigerants mix evenly under a strong disturbance effect caused by the collision of refrigerants, so as to reduce the vapour-liquid separation phenomenon of the refrigerants, facilitate a more even distribution of the refrigerants into heat exchanging tubes 300 and improve a uniformity of the distribution of the refrigerants in the heat exchanger, thus improving the performance of the heat exchanger.

Figure 12:
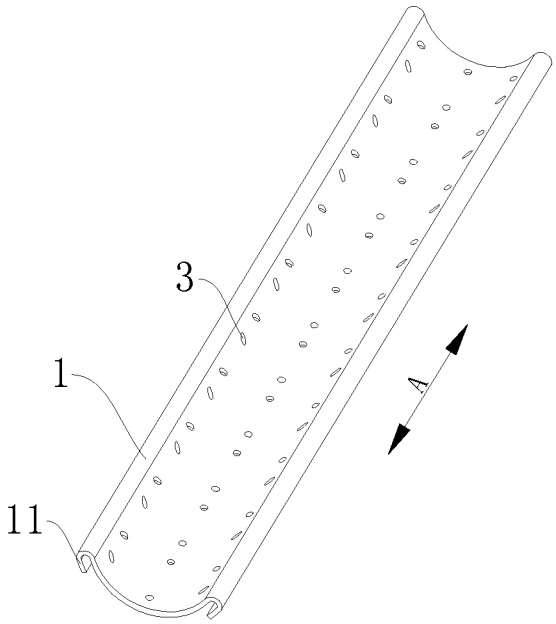
FIG. 12 is a perspective view of a refrigerant distributing component according to a fifth embodiment of the present disclosure.
Figure 13:
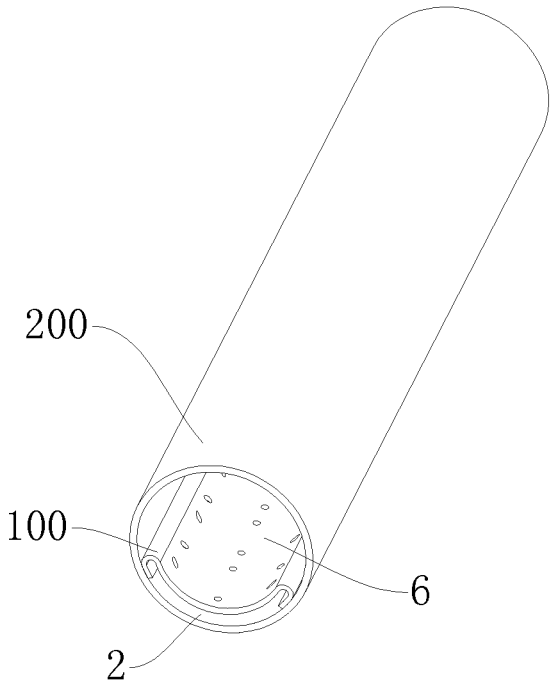
FIG. 13 is a schematic diagram of a header assembly having the refrigerant distributing component shown in FIG. 12.

In some embodiments of the present disclosure, as shown in FIG. 12 and FIG. 13, the body 1 is a plate having an arc-shaped cross-section, and two longitudinal edges (the side edges extending along a direction of an arrow A shown in FIG. 12) of the body 1 each have a turn-down 11 conformed with an inner wall of the header 200 and used to support and install the body 1 in the header 200. The cross-section of the distributing cavity 2 is arc-shaped and the inner sidewall of the body 1 has three rows of the distributing holes 3 so as to form three groups of the distributing holes 3, and each row of the distributing holes 3 includes a plurality of distributing holes 3.

Figure 14:
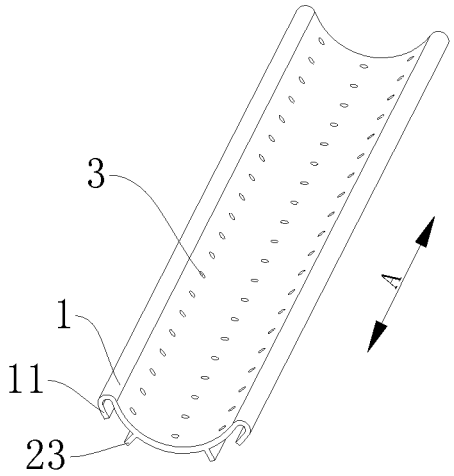
FIG. 14 is a perspective view of a refrigerant distributing component according to a sixth embodiment of the present disclosure.
Figure 15:
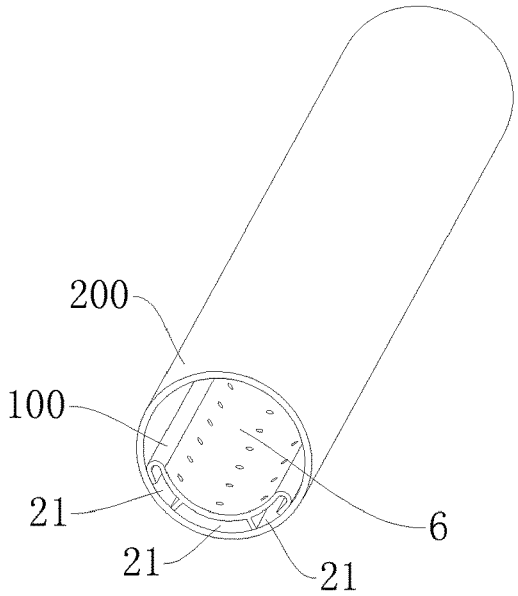
FIG. 15 is a schematic diagram of a header assembly having the refrigerant distributing component shown in FIG. 14.

In the examples shown in FIG. 14 and FIG. 15, the body 1 is a plate with an arc-shaped cross-section, and two longitudinal edges of the body 1 each have a turn-down 11 conformed with an inner wall of the header 200. A surface of the body 1 adjacent to the distributing cavity 2 has separating ribs 23 extending in the length direction of the body 1, and the ribs 23 divide the distributing cavity 2 into a plurality of distributing channels 21 and each of the cross-sections of the distributing channels 21 is arc-shaped. As shown in FIG. 14 and FIG. 15, the separating ribs are two in number and are provided in the distributing cavity 2 to divide the distributing cavity 2 into three distributing channels 21. Each of the inner sidewalls of the distributing channels 21 has a row of distributing holes 3 therein.

Figure 16:
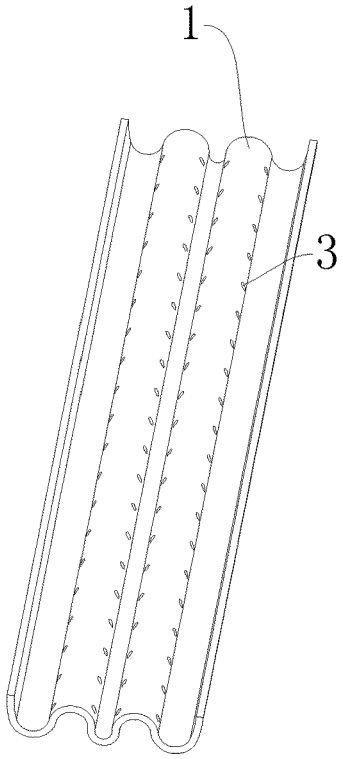
FIG. 16 is a perspective view of a refrigerant distributing component according to a seventh embodiment of the present disclosure.
Figure 17:
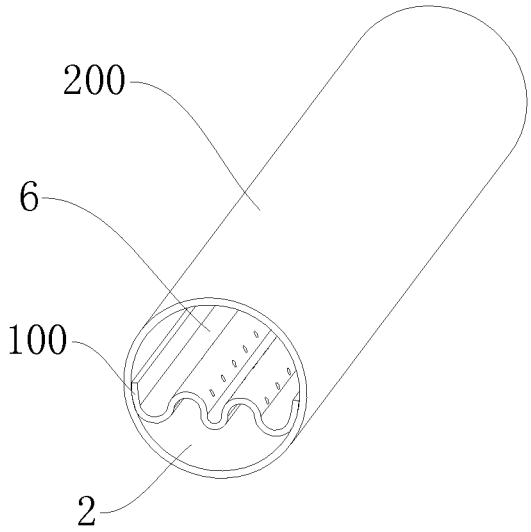
FIG. 17 is a schematic diagram of a header assembly having the refrigerant distributing component shown in FIG. 16.

In the examples shown in FIG. 16 and FIG. 17, the body 1 is a plate having a corrugated cross-section, and the inner sidewall surface of the body 1 has a plurality of rows of the distributing holes 3 therein so as to form a plurality of groups of the distributing holes 3. More specifically, two sides of each wave peak each have a row of distributing holes 3, and the refrigerants sprayed from two rows of the distributing holes 3 between adjacent two wave peaks collide with each other.

A heat exchanger according to embodiment of the present disclosure is described following with reference to FIG. 1 to FIG. 18.

Figure 18:
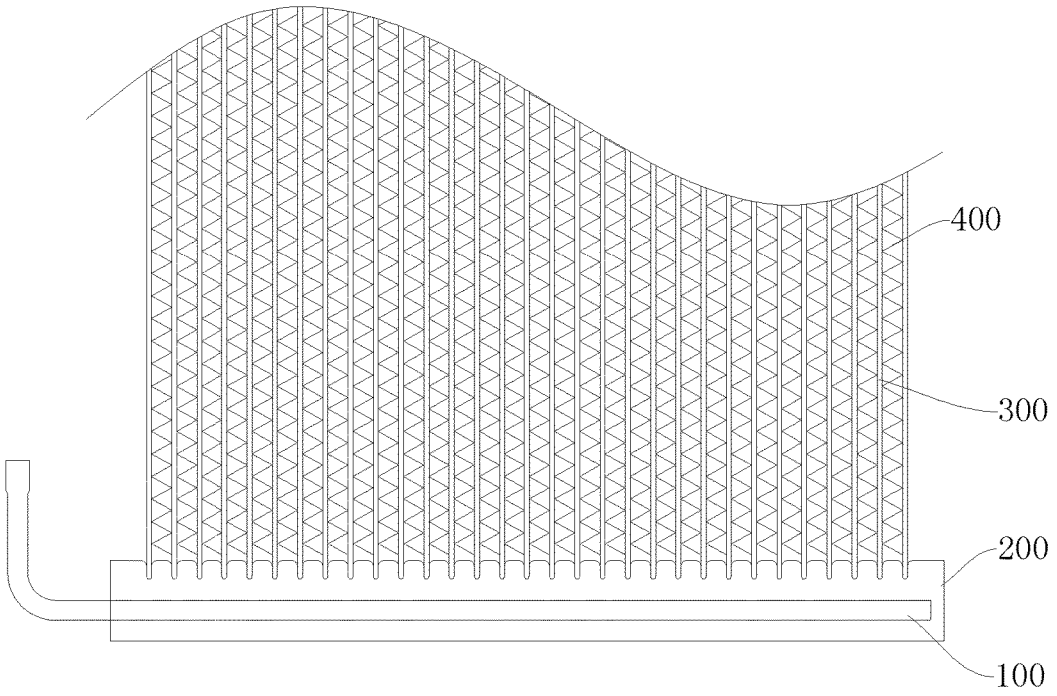
FIG. 18 is a schematic diagram of a heat exchanger according to an embodiment of the present disclosure.

As shown in FIG. 18, the heat exchanger according to embodiment of the present disclosure includes two headers 200, a heat exchanging tube 300, a fin 400 and a refrigerant distributing component 100. Two ends of the heat exchanging tube 300 are connected to the two headers 200 respectively. Preferably, the heat exchanging tube 300 is configured to be a flat tube. The fin 400 is disposed between the adjacent heat exchanging tubes 300. The refrigerant distributing component 100 is disposed in at least one of the two headers 200, and the refrigerant distributing component 100 and the header 200 form a header assembly, which is the header assembly described in the above embodiments.

The heat exchanger according to embodiments of the present disclosure may be a parallel-flow heat exchanger, such as a micro-channel heat exchanger.

The heat exchanger according to embodiments of the present disclosure, through the refrigerant distributing device, can reduce the vapour-liquid separation phenomenon of the refrigerants and improve the homogeneity of the distribution of the refrigerants, thus improving the performance of the heat exchanger.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counter-clockwise" should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may include one or more of this feature. In the description of the present disclosure, unless specified otherwise, "a plurality of" means two or more than two.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A refrigerant distributing component, comprising: a body having a distributing cavity extending along a length direction of the body therein, wherein an inner sidewall of the distributing cavity has a plurality of distributing holes, and refrigerants sprayed from one part of the distributing holes collide with refrigerants sprayed from another part of the distributing holes;

said distributing cavity including a plurality of distributing channels arranged and spaced apart along a circumferential direction of the body; and wherein the body has an arc-shaped cross-section and the distributing channel has a circular cross-section, a distance from a center of the distributing channel to the center of the circle of the body is L and a hydraulic diameter of the distributing channel is R, and an included angle between two lines connecting centers of the distributing holes of two outermost distributing channels to the center of the circle is a, wherein 2N $\arctan(R/L)<\alpha<\pi$.

2. The refrigerant distributing component according to claim 1, wherein the distributing holes are divided into a plurality of groups, and refrigerants sprayed from at least one group of the distributing holes collide with refrigerants sprayed from at least another group of the distributing holes.

3. The refrigerant distributing component according to claim 2, wherein refrigerants sprayed from any two groups of the distributing holes collide with each other.

4. The refrigerant distributing component according to claim 2, wherein the distributing holes in each group are arranged in a line along a length direction of the body.

5. The refrigerant distributing component according to claim 1, wherein the distributing holes are divided into a plurality of groups, and refrigerants sprayed from one part of the distributing holes in any group collide with refrigerants sprayed from another part of the distributing holes in the same group.

6. The refrigerant distributing component according to claim 1, wherein the body has an arc-shaped cross-section, and the refrigerants sprayed from one part of the distributing holes collide with the refrigerants sprayed from another part of the distributing holes in a circle wherein a center of the body serves as a center of the circle and a radius of the body serves as a radius of the circle.

7. The refrigerant distributing component according to claim 1, wherein an inner sidewall of each distributing channel has at least one row of the distributing holes therein.

8. The refrigerant distributing component according to claim 1, wherein the body has an arc-shaped cross-section and the distributing channel has an arc-shaped cross-section.

9. The refrigerant distributing component according to claim 1, wherein a circumferential groove is provided in inner surfaces of two ends of the body.

10. A header assembly, comprising:

a header;

a refrigerant distributing component, disposed in the header, comprising: a body having a distributing cavity extending along a length direction of the body therein, wherein an inner sidewall of the distributing cavity has a plurality of distributing holes, and refrigerants sprayed from one part of the distributing holes collide with refrigerants sprayed from another part of the distributing holes;

said distributing cavity including a plurality of distributing channels arranged and spaced apart along a circumferential direction of the body, and wherein the body has an arc-shaped cross-section and the distributing channel has a circular cross-section, a distance from a center of the distributing channel to the center of the circle of the body is L and a hydraulic diameter of the distributing channel is R, and an included angle between two lines connecting centers of the distributing holes of two outermost distributing channels to the center of the circle is a, wherein $2N \arctan(R/L)<\alpha<\pi$.

11. The header assembly according to claim 10, wherein an outer sidewall surface of the body of the refrigerant distributing component is conformed together with an inner wall surface of the header.

12. A header assembly, comprising:

a header;

a refrigerant distributing component comprising a body, wherein the body is disposed in the header and divides an inner cavity of the header into an distributing cavity and a mixing cavity, and has a plurality of distributing holes communicating the distributing cavity and the mixing cavity, wherein refrigerants sprayed from one part of the distributing holes collide with refrigerants sprayed from another part of the distributing holes in the mixing cavity;

wherein two longitudinal edges of the body each have a turn-down conformed with an inner wall of the header.

13. The header assembly according to claim 12, wherein the body is formed as a plate having an arc-shaped or a corrugated cross-section.

14. The header assembly according to claim 12, wherein a surface of the body adjacent to the distributing cavity has a separating rib extending in a length direction of the body, and the separating rib divides the distributing cavity into a plurality of distributing channels.

15. The header assembly according to claim 12, wherein the distributing holes are divided into a plurality of groups, and refrigerants sprayed from any two groups of the distributing holes collide with each other.

16. A heat exchanger, comprising a header assembly, wherein the header assembly comprises:

a header;

a refrigerant distributing component comprising a body, wherein the body is disposed in the header and divides an inner cavity of the header into an distributing cavity and a mixing cavity, and has a plurality of distributing holes communicating the distributing cavity and the mixing cavity, wherein refrigerants sprayed from one part of the distributing holes collide with refrigerants sprayed from another part of the distributing holes in the mixing cavity; and wherein two longitudinal edges of the body each have a turn-down conformed with an inner wall of the header.

* * * * *